US010077486B2

(12) United States Patent
Takashima et al.

(10) Patent No.: US 10,077,486 B2
(45) Date of Patent: Sep. 18, 2018

(54) HIGH-STRENGTH COLD-ROLLED STEEL SHEET AND METHOD OF MANUFACTURING THE SAME

(71) Applicant: JFE Steel Corporation, Tokyo (JP)

(72) Inventors: Katsutoshi Takashima, Tokyo (JP); Yoshihiko Ono, Tokyo (JP); Kohei Hasegawa, Tokyo (JP)

(73) Assignee: JFE Steel Corporation (JP)

( * ) Notice: Subject to any disclaimer, the term of this patent is extended or adjusted under 35 U.S.C. 154(b) by 260 days.

(21) Appl. No.: 14/911,059

(22) PCT Filed: Jul. 18, 2014

(86) PCT No.: PCT/JP2014/003826
§ 371 (c)(1),
(2) Date: Feb. 9, 2016

(87) PCT Pub. No.: WO2015/019558
PCT Pub. Date: Feb. 12, 2015

(65) Prior Publication Data

US 2016/0177414 A1 Jun. 23, 2016

(30) Foreign Application Priority Data

Aug. 9, 2013 (JP) ..... 2013-165772

(51) Int. Cl.

| | |
|---|---|
| ***C22C 38/02*** | (2006.01) |
| ***C22C 38/04*** | (2006.01) |
| ***C22C 38/06*** | (2006.01) |
| ***C21D 9/46*** | (2006.01) |
| ***C21D 8/02*** | (2006.01) |
| ***C21D 6/00*** | (2006.01) |
| ***C22C 38/00*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |
| ***C21D 1/84*** | (2006.01) |
| ***C21D 8/04*** | (2006.01) |
| ***C21D 1/25*** | (2006.01) |

(52) U.S. Cl.

CPC ..... *C21D 9/46* (2013.01); *C21D 1/25* (2013.01); *C21D 1/84* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C21D 8/0473* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C21D 2211/001* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2010/0221138 | A1 | 9/2010 | Nakaya et al. | |
| 2014/0234658 | A1 | 8/2014 | Nozaki et al. | |
| 2014/0377584 | A1* | 12/2014 | Hasegawa | C23C 2/06 428/659 |

FOREIGN PATENT DOCUMENTS

| | | | | |
|---|---|---|---|---|
| CA | 2 850 044 | | 4/2013 | |
| CN | 1547620 | | 11/2004 | |
| EP | 1 431 407 | | 6/2004 | |
| EP | 1 486 574 | | 12/2004 | |
| EP | 2 765 212 | | 8/2014 | |
| EP | 2 792 760 | | 10/2014 | |
| JP | 2001-081533 | | 3/2001 | |
| JP | 2005-240178 | A | 9/2005 | |
| JP | 2010-059452 | A | 3/2010 | |
| JP | 2011-047034 | A | 3/2011 | |
| JP | 2011-052295 | A | 3/2011 | |
| JP | 2012-031462 | * | 2/2012 | C22C 38/00 |
| JP | 2012-219341 | | 11/2012 | |
| JP | 2013-032582 | A | 2/2013 | |
| KR | 10-0608555 | | 8/2006 | |

(Continued)

OTHER PUBLICATIONS

Machine English translation of JP2010-059452 A, Matsuda Hideki et al. Mar. 18, 2010.*

(Continued)

*Primary Examiner* — Deborah Yee

(74) *Attorney, Agent, or Firm* — DLA Piper LLP (US)

(57) ABSTRACT

A high-strength cold-rolled steel sheet has a composition and a microstructure. The microstructure comprises: ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite. The total number of retained austenite with a grain size of 2 μm or less, martensite with a grain size of 2 μm or less, or a mixed phase thereof is 150 or more per 2,000 $\mu m^2$ of a thickness cross section parallel to the rolling direction of the steel sheet.

21 Claims, No Drawings

(56) References Cited

FOREIGN PATENT DOCUMENTS

| | | |
|---|---|---|
| KR | 10-2011-0089077 | 8/2011 |
| WO | 2013/051238 | 4/2013 |
| WO | 2013/089095 | 6/2013 |
| WO | 2013/047838 A1 | 3/2015 |

OTHER PUBLICATIONS

Korean Office Action dated Nov. 23, 2016, of corresponding Korean Application No. 10-2015-7036350, along with a Concise Statement of Relevance of Office Action in English.
Chinese Office Action dated Sep. 28, 2016, of corresponding Chinese Application No. 201480045268.5, along with a Search Report in English.
Chinese Office Action dated Jul. 18, 2017, of corresponding Chinese Application No. 201480045268.5, along with a Concise Statement of Relevance of Office Action in English.
Supplementary European Search Report dated Jun. 3, 2016, of corresponding European Application No. 14834577.0.
European Search Report dated Apr. 19, 2018, of corresponding European Application No. 14834577.0.

* cited by examiner

HIGH-STRENGTH COLD-ROLLED STEEL SHEET AND METHOD OF MANUFACTURING THE SAME

TECHNICAL FIELD

This disclosure relates to high-strength cold-rolled steel sheets and methods of manufacturing the same and particularly relates to a high-strength cold-rolled steel sheet suitable for use in members for structural parts of automobiles and the like and a method of manufacturing the high-strength cold-rolled steel sheet.

BACKGROUND

In recent years, $CO_2$ emissions have been strictly regulated due to growing environmental issues. In the automotive field, improvements in fuel efficiency by reduction in weight of automobile bodies are significant challenges. Therefore, weight reduction by applying high-strength steel sheets to automobile parts is in progress. In particular, high-strength steel sheets with a tensile strength (TS) of 1,180 MPa or more are applied to automobile parts.

High-strength steel sheets for use in automobile parts such as structural members and reinforcing members for automobiles are required to have excellent formability. In particular, a high-strength steel sheet for use in parts with a complicated shape is required to have both excellent elongation and stretch flangeability (also referred to as hole-expandability) rather than either one. Furthermore, automobile parts such as structural members and reinforcing members are required to have excellent impact energy absorption capability. Increasing the yield ratio of a steel sheet used is effective in enhancing the impact energy absorption capability thereof. Automobile parts manufactured using a steel sheet with high yield ratio can efficiently absorb impact energy with low deformation. Herein, the yield ratio (YR) is a value representing the ratio of the yield stress (YS) to the tensile strength (TS) and is given by the equation YR=YS/TS.

Dual-phase steels (DP steels) with a ferrite-martensite microstructure are conventionally known as high-strength steel sheets having high strength and formability. DP steel is multi-phase steel in which ferrite is a primary phase and martensite is distributed. DP steel has low yield ratio, high TS, and excellent elongation. However, DP steel has a disadvantage that stress is likely to concentrates at the interface between ferrite and martensite during deformation to cause cracks and therefore the stretch flangeability is low. As DP steel excellent in stretch flangeability, Japanese Unexamined Patent Application Publication No. 2011-052295 discloses a technique wherein a dual-phase microstructure is composed of tempered martensite and ferrite, the balance between elongation and stretch flangeability is ensured and a high strength of TS 1,180 MPa or more is achieved by controlling the hardness and area fraction of tempered martensite and the distribution of cementite grains in tempered martensite.

A TRIP steel sheet based on the transformation-induced plasticity of retained austenite is cited as a steel sheet having high strength and excellent ductility. TRIP steel sheets have microstructures containing retained austenite. In deforming a TRIP steel sheet at a temperature not lower than the martensite transformation start temperature, retained austenite is induced to transform into martensite by stress, whereby a large elongation is achieved. However, TRIP steel sheets have problem with poor stretch flangeability (stretch flangeability) because retained austenite is transformed into martensite during punching and therefore cracks are caused at the interfaces between ferrite and martensite. As a TRIP steel sheet with excellent stretch flangeability, Japanese Unexamined Patent Application Publication No. 2005-240178 discloses a low-yield ratio, high-strength cold-rolled steel sheet which has a microstructure containing at least 5% retained austenite, at least 60% bainitic ferrite, and 20% or less (including 0%) polygonal ferrite, which is excellent in elongation and stretch flangeability, and which has high strength, a TS of 980 MPa or more. Japanese Unexamined Patent Application Publication No. 2011-047034 discloses a high-strength steel sheet in which the area fraction of ferrite, bainite, and retained austenite is regulated; which has a microstructure with a martensite area fraction of 50% or more; in which the hardness distribution of martensite is controlled; and which has a TS of 980 MPa or more, excellent elongation, and excellent stretch flangeability.

However, steels such as DP steels based on martensite transformation generally have low yield ratio and reduced impact energy absorption capability because mobile dislocations are introduced into ferrite during martensite transformation. The steel sheets disclosed in JP '295 are insufficient in formability, particularly elongation. The steel sheets disclosed in JP '178 have a high strength of 980 MPa or more and, however, have no enhanced elongation or stretch flangeability in a high-strength range of 1,180 MPa or more. The steel sheets disclosed in JP '034 are insufficient in elongation and stretch flangeability.

As described above, in steel sheets with a high strength of 1,180 MPa or more, it is difficult that high yield ratio is maintained and excellent elongation and stretch flangeability are ensured such that excellent impact energy absorption capability is achieved. Therefore, the development of a steel sheet having these properties has been desired.

It could therefore be helpful to provide a high-strength cold-rolled steel sheet having excellent elongation, excellent stretch flangeability, and high yield ratio and a method of manufacturing the same.

SUMMARY

We thus provide:

(1) A high-strength cold-rolled steel sheet has a composition and a microstructure, the composition comprising:

0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities, and the microstructure comprising:

ferrite having an average grain size of ferrite is 5 μm or less and a volume fraction of 3% to 20%, retained austenite having a volume fraction of 5% to 20%, and martensite having a volume fraction of 5% to 20%, the remainder being bainite and/or tempered martensite; and the total number of retained austenite with a grain size of 2 μm or less, martensite with a grain size of 2 μm or less, or a mixed phase thereof being 150 or more per 2,000 $\mu m^2$ of a thickness cross section parallel to the rolling direction of the steel sheet.

(2) The high-strength cold-rolled steel sheet specified in Item (1) further contains at least one selected from the group consisting of 0.10% or less V, 0.10% or less Nb, and 0.10% or less Ti on a mass basis.

(3) The high-strength cold-rolled steel sheet specified in Item (1) or (2), wherein the composition further contains 0.0050% or less B on a mass basis.

(4) The high-strength cold-rolled steel sheet specified in any one of Items (1) to (3), wherein the composition further contains at least one selected from the group consisting of 0.50% or less Cr, 0.50% or less Mo, 0.50% or less Cu, and 0.50% or less Ni on a mass basis.

(5) The high-strength cold-rolled steel sheet specified in any one of Items (1) to (4), wherein the composition further contains at least one selected from the group consisting of 0.0050% or less Ca and 0.0050% or less of a REM on a mass basis.

(6) A method of manufacturing a high-strength cold-rolled steel sheet, comprising:

preparing a steel slab having the composition specified in any one of Items (1) to (5);

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the a second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

A high-strength cold-rolled steel sheet which has high strength and high yield ratio and is excellent in both elongation and stretch flangeability can be reliably achieved by controlling the composition and microstructure of a steel sheet.

DETAILED DESCRIPTION

We found that high yield ratio is ensured and high elongation and excellent stretch flangeability are achieved such that the volume fraction of each of ferrite, retained austenite, and martensite in the microstructure of a steel sheet is controlled to a specific value and the average grain size of ferrite and the size and number of martensite, retained austenite, or a mixture thereof are controlled.

We have investigated the relationship between the microstructure of steel sheets and properties such as tensile strength, yield ratio, and elongation and found as described below:

(a) When martensite or retained austenite is present in the microstructure of a steel sheet, voids form at the interface between ferrite and martensite or retained austenite in a hole-expanding test and the voids coalesce and develop in a subsequent hole-expanding course to cause cracks. Therefore, it is difficult to ensure good stretch flangeability.

(b) When a steel sheet has a microstructure containing bainite or tempered martensite with high dislocation density, the steel sheet has increased yield strength. Hence, high yield ratio can be achieved and good stretch flangeability can be also achieved. However, in this case, elongation is low.

(c) Containing soft ferrite or retained austenite is effective in increasing elongation and, however, leads to a reduction in tensile strength or stretch flangeability.

We further found that the number of voids caused by punching can be suppressed, elongation or yield ratio can be ensured, and stretch flangeability (stretch flangeability) can be enhanced such that ferrite is solid-solution-strengthened by adding an adequate amount of Si t6o steel and martensite, retained austenite, or a mixture thereof is reduced in grain size and is distributed in steel.

We still further found that the volume fraction of each of ferrite, retained austenite, and martensite can be controlled; martensite with a grain size of 2 μm or less, retained austenite with a grain size of 2 μm or less, or a mixture thereof can be finely distributed in steel; high yield ratio can be ensured; and elongation and stretch flangeability can be enhanced such that the content of Si is adjusted within the range of 0.8% to 2.4% by mass and annealing is performed twice under predetermined conditions.

Reasons for limiting components of our high-strength cold-rolled steel sheets are described. The unit "%" used to express the content of each component of steel refers to "mass percent."

C: 0.15% to 0.27%

C is an element effective in strengthening a steel sheet and involves forming secondary phases such as bainite, tempered martensite, retained austenite, and martensite to contribute to strengthening. It is difficult to ensure bainite, tempered martensite, retained austenite, and martensite when the content of C is less than 0.15%. Therefore, the content of C is 0.15% or more. The content of C is preferably 0.16% or more. However, when the content of C is more than 0.27%, the difference in hardness between ferrite, tempered martensite, and martensite is large and therefore stretch flangeability is low. Therefore, the content of C is 0.27% or less. The content of C is preferably 0.25% or less.

Si: 0.8% to 2.4%

Si is an element producing ferrite and is also an element effective in solid solution strengthening. The content of Si is 0.8% or more to ensure ferrite and achieve high tensile strength and excellent elongation. The content of Si is preferably 1.2% or more. However, when the content of Si is more than 2.4%, chemical treatability is low. Therefore, the content of Si is 2.4% or less. The content of Si is preferably 2.1% or less.

Mn: 2.3% to 3.5%

Mn is an element effective in solid solution strengthening and also an element that involves forming secondary phases such as bainite, tempered martensite, retained austenite, and martensite to contribute to strengthening. Mn stabilizes austenite and is necessary to control the fraction of a secondary phase. The content of Mn is 2.3% or more to achieve these effects. However, when the content of Mn is more than 3.5%, the volume fraction of martensite is extremely large and stretch flangeability is low. Therefore, the content of Mn is 3.5% or less. The content of Mn is preferably 3.3% or less.

P: 0.08% or Less

P contributes to strengthening by solid solution strengthening. However, when P is excessively added, P significantly segregates at grain boundaries to embrittle the grain boundaries and reduces weldability. Therefore, the content of P is 0.08% or less. The content of P is preferably 0.05% or less.

S: 0.005% or Less

When the content of S is more than 0.005%, large amounts of sulfides such as MnS are produced to reduce stretch flangeability. Therefore, the content of S is 0.005% or less. The content of S is preferably 0.0045% or less. The lower limit of the content of S is not particularly limited. Minimizing the content of S causes an increase in steelmaking cost. Therefore, the content of S is preferably 0.0005% or more.

Al: 0.01% to 0.08%

Al is an element necessary for deoxidation. The content of Al is 0.01% or more to achieve this effect. However, when the content of Al is more than 0.08%, this effect is saturated. Therefore, the content of Al is 0.08% or less. The content of Al is preferably 0.05% or less.

N: 0.010% or Less

N tends to form coarse nitrides to deteriorate bendability and stretch flangeability. This tendency is significant when the content of N is more than 0.010%. Therefore, the content of N is 0.010% or less. The content of N is preferably 0.0050% or less. The content of N is preferably low.

One or more selected from the group consisting of 0.10% or less V, 0.10% or less Nb, and 0.10% or less Ti; one or more selected from the group consisting of 0.0050% or less B, 0.50% or less Cr, 0.50% or less Mo, 0.50% or less Cu, and 0.50% or less Ni; and one or more selected from the group consisting of 0.0050% or less Ca and 0.0050% or less of a REM may be added separately or together.

V: 0.10% or Less

V forms a fine carbonitride to contribute to an increase in strength. The content of V is preferably 0.01% or more to achieve this effect. However, even if more than 0.10% V is added, the effect of increasing strength is small and an increase in alloying cost is caused. Thus, the content of V is 0.10% or less.

Nb: 0.10% or Less

Nb, as well as V, forms a fine carbonitride to contribute to an increase in strength and therefore may be added as required. The content of Nb is preferably 0.005% or more to exhibit this effect. However, when more than 0.10% Nb is added, elongation is significantly reduced. Therefore, the content of Nb is 0.10% or less.

Ti: 0.10% or Less

Ti, as well as V, forms a fine carbonitride to contribute to an increase in strength and therefore may be added as required. The content of Ti is preferably 0.005% or more to exhibit this effect. However, when more than 0.10% Ti is added, elongation is significantly reduced. Therefore, the content of Ti is 0.10% or less.

B: 0.0050% or Less

B is an element that enhances hardenability and forms a secondary phase to contribute to strengthening. The content of B is preferably 0.0003% or more to exhibit these effects. However, when the content of B is more than 0.0050%, these effects are saturated. Therefore, the content of B is 0.0050% or less. The content of B is preferably 0.0040% or less.

Cr: 0.50% or Less

Cr is an element that forms a secondary phase to contribute to strengthening and may be added as required. The content of Cr is preferably 0.10% or more to exhibit this effect. However, when the content of Cr is more than 0.50%, martensite is excessively produced. Therefore, the content of Cr is 0.50% or less.

Mo: 0.50% or Less

Mo, as well as Cr, is an element that forms a secondary phase to contribute to strengthening. Mo is also an element that partly forms a carbide to contribute to strengthening and may be added as required. The content of Mo is preferably 0.05% or more to exhibit these effects. However, when the content of Mo is more than 0.50%, these effects are saturated. Therefore, the content of Mo is 0.50% or less.

Cu: 0.50% or Less

Cu, as well as Cr, is an element that forms a secondary phase to contribute to strengthening. Cu is also an element that contributes to strengthening by solid solution strengthening and may be added as required. The content of Cu is preferably 0.05% or more to exhibit these effects. However, when the content of Cu is more than 0.50%, these effects are saturated and surface defects due to Cu are likely to be caused. Therefore, the content of Cu is 0.50% or less.

Ni: 0.50% or Less

Ni, as well as Cr, is an element that forms a secondary phase to contribute to strengthening and which contributes to strengthening by solid solution strengthening and may be added as required. The content of Ni is preferably 0.05% or more to exhibit these effects. Adding Ni together with Cu is effective in suppressing surface defects due to Cu. Therefore, Ni is particularly effective in adding Cu. These effects are saturated when the content is more than 0.50%. Therefore, the content of Ni is 0.50% or less.

Ca: 0.0050% or Less

Ca is an element that spheroidizes sulfides to contribute to improving the adverse influence of the sulfides on stretch flangeability and may be added as required. The content of Ca is preferably 0.0005% or more to exhibit this effect. However, when the content of Ca is more than 0.0050%, this effect is saturated. Therefore, the content of Ca is 0.0050% or less.

REM: 0.0050% or Less

REM, as well as Ca, are elements that spheroidize sulfides to contribute to improving the adverse influence of the sulfides on stretch flangeability and may be added as required. The content of the REM is preferably 0.0005% or more to exhibit this effect. However, when the content of REM is more than 0.0050%, this effect is saturated. Therefore, the content of the REM is 0.0050% or less.

The remainder, other than the above components, are Fe and inevitable impurities. Examples of the inevitable impurities include Sb, Sn, Zn, and Co. Regarding the acceptable range of the inevitable impurities, the content of Sb is 0.01% or less, the content of Sn is 0.1% or less, the content of Zn is 0.01% or less, and the content of Co is 0.1% or less. Even if Ta, Mg, or Zr is contained within the usual range of the composition of steel, the effects thereof are not lost.

The microstructure of the high-strength cold-rolled steel sheet is described below in detail.

Average Grain Size of Ferrite: 5 μm or Less, Volume Fraction of Ferrite: 3% to 20%

When the average grain size of ferrite is more than 5 μm, voids formed in a punched surface by hole expanding are likely to coalesce during hole expanding, that is, voids formed in a punched surface are likely to coalesce during stretch flange forming and good stretch flangeability is not achieved. Therefore, the average grain size of ferrite is 5 μm or less. When the volume fraction of ferrite is less than 3%, soft ferrite is insufficient to ensure good elongation. Therefore, the volume fraction of ferrite is 3% or more. The volume fraction of ferrite is preferably 5% or more. However, when the volume fraction of ferrite is more than 20%, many hard secondary phases are present and many portions with a large difference in hardness from soft ferrite are present, leading to a reduction in stretch flangeability. Furthermore, it is difficult to ensure a tensile strength of 1,180 MPa or more. Therefore, the volume fraction of ferrite is 20% or less. The volume fraction of ferrite is preferably 15% or less.

Volume Fraction of Retained Austenite: 5% to 20%

The volume fraction of retained austenite needs to be 5% or more to ensure sufficient elongation. The volume fraction of retained austenite is preferably 8% or more. However, when the volume fraction of retained austenite is more than 20%, stretch flangeability is low. Therefore, the volume fraction of retained austenite is 20% or less.

Volume Fraction of Martensite: 5% to 20%

The volume fraction of martensite needs to be 5% or more to ensure desired tensile strength. To ensure good stretch flangeability, the volume fraction of martensite, which is a soft microstructure, needs to be 20% or less. The term "martensite" as used herein refers to martensite produced when austenite remaining untransformed after being held in a second holding temperature range of 320° C. to 500° C. during second annealing is cooled to room temperature.

Total Number of Retained Austenite with Grain Size of 2 μm or Less, Martensite with Grain Size of 2 μm or Less, or Mixture Thereof: 150 or More To ensure desired tensile strength and good stretch flangeability, it is advantageous that, among the retained austenite and the martensite, fine retained austenite and martensite with a grain size of 2 μm or less are massively present. In the observation of the microstructure of a through-thickness cross section of a steel sheet, retained austenite and martensite are observed in the form of a mixed phase thereof in some cases. To ensure desired stretch flangeability, the total number of retained austenite with a grain size of 2 μm or less, martensite with a grain size of 2 μm or less, or the mixture thereof needs to be 150 or more in a cross section of a steel sheet, particularly per 2,000 $\mu m^2$ of a through-thickness cross section parallel to the rolling direction of the steel sheet. When the grain size is more than 2 μm, voids are likely to coalesce during stretch flange forming such as hole expanding. Therefore, the grain size is 2 μm or less. When the total number per 2,000 $\mu m^2$ of the through-thickness cross section parallel to the rolling direction of the steel sheet is less than 150, it is difficult to ensure tensile strength. The total number is preferably 180 or more. However, when the total number is more than 450, voids are likely to coalesce during stretch flange forming such as hole expanding. Therefore, the total number is preferably 450 or less.

Rest Microstructure: Microstructure Containing Bainite and/or Tempered Martensite The high-strength cold-rolled steel sheet needs to contain bainite and/or tempered martensite to ensure good stretch flangeability and high yield ratio. The volume fraction of bainite is preferably 20% to 50%. The volume fraction of tempered martensite is preferably 15% to 50%. The term "volume fraction of bainite phase" as used herein refers to the volume percentage of bainitic ferrite (ferrite with high dislocation density) in a viewing surface. The term "tempered martensite" as used herein refers to martensite which is transformed from untransformed austenite in the course of cooling to a cooling stop temperature during second annealing and which is tempered when being held in the second holding temperature range of 320° C. to 500° C.

Although one or more of pearlite, spherical cementite, and the like are produced in some cases in addition to ferrite, bainite, tempered martensite, retained austenite, and martensite, it is advantageous when the volume fraction of each of ferrite, retained austenite, and martensite, the average grain size of ferrite, the size and number of fine grains of retained austenite, martensite, or the mixture thereof observed in the through-thickness cross section of the steel sheet satisfy the above-mentioned ranges and the rest microstructure contains bainite and/or retained austenite. The volume fraction of microstructures other than ferrite, bainite, tempered martensite, retained austenite, and martensite is preferably 5% or less in total.

A method (an example) of manufacturing the high-strength cold-rolled steel sheet is described below.

The high-strength cold-rolled steel sheet can be manufactured as follows: for example, a steel slab having the above-mentioned composition is hot-rolled; pickled; cold-rolled; subjected to first annealing such that the steel slab is heated to a temperature range of 800° C. or higher, held at a first soaking temperature of 800° C. or higher for 30 seconds or more, cooled from the first soaking temperature to a first holding temperature range of 320° C. to 500° C. at a first average cooling rate of 3° C./s or more, held in the first holding temperature range of 320° C. to 500° C. for 30 seconds or more, and cooled to room temperature; and subjected to second annealing such that the steel slab is heated to a temperature range of 750° C. or higher at an average heating rate of 3° C./s to 30° C./s, held at a second soaking temperature of 750° C. or higher for 30 seconds or more, cooled from the second soaking temperature to a cooling stop temperature of 120° C. to 320° C. at a second average cooling rate of 3° C./s or more, heated to the second holding temperature range of 320° C. to 500° C., held in the second holding temperature range of 320° C. to 500° C. for 30 seconds or more, and then cooled to room temperature.

The manufacturing method significantly features an annealing step in which annealing is performed twice. The annealing step is performed to allow recrystallization to proceed and to form bainite, tempered martensite, retained austenite, and martensite in the microstructure of the steel sheet for the purpose of strengthening. Annealing is performed twice to form fine grains of martensite and retained austenite in the microstructure of the steel sheet. In the course of cooling during the first annealing, untransformed austenite is subjected to bainite transformation, whereby large amounts of martensite and fine retained austenite are left. However, it is difficult to ensure good stretch flangeability by performing annealing once only because the size of martensite grains is large. Therefore, a second annealing is performed to reduce the size of the martensite grains. This allows martensite and retained austenite produced by the first annealing to serve as nuclei for austenite produced during the second annealing, thereby enabling fine phases to be maintained during annealing. That is, a microstructure in which bainite, martensite, and retained austenite are homogenized to a certain extent can be obtained by first annealing and a microstructure in which martensite and retained austenite are homogeneously and finely distributed can be obtained by second annealing. In the second annealing, to produce tempered martensite, after excessive cooling is performed once, reheating is performed after excessive cooling. This enables stretch flangeability to be enhanced without deteriorating elongation. Reasons for limiting annealing conditions are described below.

(1) First Annealing

First Soaking Temperature: 800° C. or Higher, Holding Time: 30 Seconds or More

In the first annealing, soaking is performed in a temperature range that is a ferrite-austenite two-phase region or an austenite single-phase region. When the first soaking temperature, which is the soaking temperature during first annealing, is lower than 800° C., the amount of bainite present after first annealing is small and therefore the grain size of martensite, retained austenite or the mixture thereof is large, leading to a reduction in flange formability. Therefore, the lower limit of the first soaking temperature is 800° C. The lower limit of the first soaking temperature is preferably 850° C. or higher. From the viewpoint of suppressing coarsening of grains, the upper limit of the first soaking temperature is preferably 920° C. To allow recrystallization to proceed at the first soaking temperature and to induce partial or complete austenite transformation at the first soaking temperature, the holding time (also referred to as the first soaking time) at the first soaking temperature needs to be 30 seconds or more. The upper limit of the first soaking time is not particularly limited and is preferably 600 seconds or less.

First Average Cooling Rate: Cooling to 320° C. to 500° C. (First Holding Temperature Range) at 3° C./s or More Cooling from the first soaking temperature to a temperature range of 320° C. to 500° C., that is, the first holding temperature range is important in ensuring the presence of bainite. When the average cooling rate from the first soaking temperature to a temperature range of 320° C. to 500° C. is less than 3° C./s, large amounts of ferrite, pearlite, and spherical cementite are produced in the microstructure of a steel sheet and therefore it is difficult to obtain a microstructure containing bainite. Therefore, the average cooling rate from the first soaking temperature needs to be 3° C./s or more. The upper limit of the first average cooling rate is not particularly limited. The first average cooling rate is preferably 45° C./s or less to obtain a desired microstructure.

When the cooling stop temperature during cooling from the first soaking temperature is lower than 320° C., massive martensite is excessively produced during cooling and therefore it is difficult to finely homogenize martensite by the second annealing, leading to a reduction in stretch flangeability. However, when the cooling stop temperature is higher than 500° C., pearlite is excessively increased and therefore it is difficult to finely homogenize martensite, retained austenite, and the like by the second annealing, leading to a reduction in stretch flangeability. Therefore, cooling is performed from the first soaking temperature to the first holding temperature range of 320° C. to 500° C. The cooling stop temperature is preferably 350° C. to 450° C.

Holding in First Holding Temperature Range of 320° C. to 500° C. for 30 Seconds or More After cooling at the first cooling rate is stopped, holding is performed in the first holding temperature range, which is 320° C. to 500° C., whereby untransformed austenite is subjected to bainite transformation, whereby bainite and retained austenite are produced. Pearlite is excessively produced in the microstructure of the steel sheet when the holding time after cooling is higher than 500° C. Martensite is excessively produced when the holding time after cooling is lower than 320° C. Therefore, fine martensite or retained austenite cannot be obtained after second annealing. When the holding time in the first holding temperature range is less than 30 seconds, a large amount of massive martensite is produced in the microstructure of the steel sheet after the second annealing because the amount of untransformed austenite is large. Hence, martensite and the like cannot be finely homogenized by the second annealing. Therefore, holding is performed in the first holding temperature of 320° C. to 500° C. for 30 seconds or more. The upper limit of the holding time is not particularly limited and is preferably 2,000 seconds or less. After holding in the first holding temperature range, cooling to room temperature is performed.

(2) Second Annealing

Heating to Second Soaking Temperature of 750° C. or Higher at Average Heating Rate of 3° C./s to 30° C./s In the second annealing, the production rate of nuclei of ferrite and austenite produced by recrystallization is adjusted to be higher than the growth rate of produced grains, whereby annealed grains are made fine. When the average heating rate to the soaking temperature during second annealing is more than 30° C./s, recrystallization is unlikely to proceed. Therefore, the upper limit of the average heating rate is 30° C./s. However, when the average heating rate is less than 3° C./s, ferrite grains are coarsened and therefore a predetermined average grain size is not achieved. Therefore, the average heating rate needs to be 3° C./s or more. From the viewpoint of obtaining fine grains, the average heating rate is preferably 7° C./s to 20° C./s.

Soaking Temperature (Second Soaking Temperature): 750° C. or Higher, Holding Time: 30 Seconds or More When the second soaking temperature, which is the soaking temperature in second annealing, is lower than 750° C., the amount of produced austenite is small and therefore the volume fraction of martensite and retained austenite cannot be sufficiently ensured. Therefore, the second soaking temperature is 750° C. or higher. The upper limit of the second soaking temperature is not particularly limited. The second soaking temperature is preferably 900° C. or lower to obtain fine martensite, retained austenite, and the like. When the holding time (also referred to as the second soaking time) at the second soaking temperature is less than 30 seconds, elements such as M are not sufficiently concentrated in austenite and therefore untransformed austenite is coarsened during cooling, leading to a reduction in stretch flangeability. Therefore, holding is performed at the second soaking temperature for 30 seconds or more. The upper limit of the holding time is not particularly limited and is preferably 1,500 seconds or less.

Cooling to 120° C. to 320° C. at Second Average Cooling Rate of 3° C./s or More

Cooling is once performed from the second soaking temperature to or below the martensite transformation start temperature, whereby martensite is produced. When the cooling stop temperature during cooling from the second soaking temperature is lower than 120° C., martensite is excessively produced during cooling, the amount of untransformed austenite is reduced, and the amount of bainite and retained austenite in a finally obtained steel sheet is reduced. Hence, good elongation cannot be ensured. However, when the cooling stop temperature during cooling from the second soaking temperature is higher than 320° C., the amount of tempered martensite in the finally obtained steel sheet is reduced and good stretch flangeability cannot be ensured.

Therefore, the cooling stop temperature during cooling from the second soaking temperature is 120° C. to 320° C. The cooling stop temperature is preferably 150° C. to 300° C. When the average cooling rate during cooling from the second soaking temperature to the cooling stop temperature is less than 3° C./s, pearlite and cementite are excessively produced in the microstructure of the finally obtained steel sheet. Therefore, the average cooling rate during cooling from the second soaking temperature to the cooling stop temperature is 3° C./s or more. The upper limit of the cooling rate is not particularly limited and is preferably 40° C./s or less for the purpose of obtaining a desired microstructure.

Holding in Second Holding Temperature Range of 320° C. to 500° C.

After cooling from the second soaking temperature, heating is performed again and holding is performed in the second holding temperature range, which is a temperature of 320° C. to 500° C., for 30 seconds or more for the purpose of tempering martensite produced during cooling to the cooling stop temperature of 120° C. to 320° C. and for the purpose of producing bainite and retained austenite in the microstructure of the steel sheet by subjecting untransformed austenite to bainite transformation. When the second holding temperature is lower than 320° C., the tempering of martensite is insufficient and therefore it is difficult to ensure good stretch flangeability. When the second holding temperature is higher than 500° C., pearlite is excessively produced, leading to a reduction in elongation. Therefore, the second holding temperature is 320° C. to 500° C. When the holding time in the second holding temperature range is less than 30 seconds, bainite transformation does not proceed sufficiently. Hence, a large amount of untransformed austenite remains and martensite is excessively produced, leading to a reduction in stretch flangeability. Therefore, the holding time in the second holding temperature is 30 seconds or more. The upper limit of the holding time in the second holding temperature range is not particularly limited and is preferably 2,000 seconds or less. After holding in the second holding temperature range, cooling to room temperature is performed.

The high-strength cold-rolled steel sheet is manufactured such that the steel slab, which has the above-mentioned composition, is roughly rolled and finish-rolled into a hot-rolled steel plate in a hot rolling step and the hot-rolled steel plate is descaled in a pickling step, cold-rolled, and then annealed twice in an annealing step as described above.

The steel slab is preferably manufactured by a continuous casting process for the purpose of preventing the macrosegregation of components. The steel slab can be manufactured by an ingot-casting process or a thin slab-casting process.

In the hot rolling step, the cast steel slab is subjected to hot rolling including rough rolling and finish rolling without being reheated or the cast steel slab is preferably reheated to 1,100° C. or higher and then subjected to hot rolling including rough rolling and finish rolling, whereby the hot-rolled steel plate is manufactured, followed by coiling. An energy-saving process such as hot-charge rolling or hot direct rolling can be used without any problem in addition to a conventional process in which after a slab is manufactured, the slab is once cooled and then reheated. In the energy-saving process, the hot slab is charged into a furnace or heat-retained without being heated and then immediately hot-rolled or the cast slab is directly hot-rolled.

When the heating temperature of the slab is lower than 1,100° C., the load of rolling is large, leading to a reduction in productivity. However, when the heating temperature of the slab is higher than 1,300° C., the heating cost is high. Therefore, the heating temperature of the slab is preferably 1,100° C. to 1,300° C.

When the finishing delivery temperature during finish rolling of hot rolling is below the temperature of an austenite single-phase region, the structural heterogeneity and property anisotropy of the steel sheet are significant and the elongation and stretch flangeability of the annealed steel sheet are likely to be deteriorated. Therefore, it is preferred that the finishing delivery temperature is equal to the temperature of the austenite single-phase region and hot rolling is completed in the austenite single-phase region. The finishing delivery temperature is preferably 830° C. or higher. However, when the finishing delivery temperature is higher than 950° C., the microstructure of the hot-rolled steel plate is coarse and properties of the annealed steel sheet are low. Therefore, the finishing delivery temperature is preferably 950° C. or lower. That is, during hot rolling, the finishing delivery temperature is preferably 830° C. to 950° C.

The hot-rolled steel plate obtained by hot rolling as described above is cooled and then coiled. A cooling method after hot rolling is not particularly limited. The coiling temperature is not particularly limited. When the coiling temperature is higher than 700° C., coarse pearlite is significantly produced to affect the formability of the annealed steel sheet. Therefore, the upper limit of the coiling temperature is preferably 700° C. and more preferably 650° C. or lower. The lower limit of the coiling temperature is not particularly limited. However, when the coiling temperature is excessively low, hard bainite and martensite are excessively produced to increase the load of cold rolling. Therefore, the coiling temperature is preferably 400° C. or higher.

After the hot rolling step, the hot-rolled steel plate is preferably descaled by pickling in the pickling step. The pickling step is not particularly limited and may be performed in accordance with common practice. The pickled hot-rolled steel plate is cold-rolled into a cold-rolled steel sheet with a predetermined thickness in a cold rolling step. Conditions for cold rolling are not particularly limited and cold rolling may be performed in accordance with common practice. Intermediate annealing may be performed before the cold rolling step to reduce the load of cold rolling. The intermediate annealing time and temperature are not particularly limited. When, for example, batch annealing is performed in the form of a coil, annealing is preferably performed at 450° C. to 800° C. for 10 minutes to 50 hours.

After the cold rolling step, the annealing step in which annealing is performed twice as described above is performed, whereby the high-strength cold-rolled steel sheet is obtained. Temper rolling may be performed after the annealing step. In performing temper annealing, the elongation preferably ranges from 0.1% to 2.0%.

Galvanizing may be performed in the annealing step or after the annealing step such that a galvanized steel sheet is manufactured. Alloying may be performed after galvanizing such that a galvannealed steel sheet is manufactured. Furthermore, the cold-rolled steel sheet may be electroplated into an electroplated steel sheet.

EXAMPLE 1

Examples are described below. This disclosure is not, however, limited to the examples. Appropriate modifications may be made that are included in the technical scope of this disclosure.

Steels each having a chemical composition (components) shown in Table 1 were produced and cast into slabs. Each slab was hot-rolled under conditions including a slab-heating temperature of 1,200° C. and a finishing delivery temperature of 900° C., whereby a hot-rolled steel plate with a thickness of 3.2 mm was manufactured. The hot-rolled steel plate was cooled to 550° C. at a cooling rate of 100° C./s, cooled at a cooling rate of 20° C./s, and then subjected to treatment corresponding to coiling at a coiling temperature of 470° C. The resulting hot-rolled steel plate was pickled and then cold-rolled, whereby a cold-rolled steel sheet (a thickness of 1.4 mm) was manufactured. Thereafter, the obtained cold-rolled steel sheet was annealed such that the cold-rolled steel sheet was heated to a first soaking temperature shown in Table 2 and held at the first soaking temperature for a first soaking time. The resulting cold-rolled steel sheet was cooled to a first holding temperature at a first average cooling rate (Cooling Rate 1) shown in Table 2, held for a first holding time shown in Table 2, and then cooled to room temperature. The first holding time shown in Table 2 is a holding time in a first holding temperature range. Thereafter, the cold-rolled steel sheet was heated to a second soaking temperature at an average heating rate shown in Table 2, held at the second soaking temperature for a second soaking time, cooled to a cooling stop temperature at a second average cooling rate (Cooling Rate 2) shown in Table 2, heated to a second holding temperature shown in Table 2, held for a time (second holding time) shown in Table 2, and then cooled to room temperature. The second holding time shown in Table 2 is a holding time in a second holding temperature range.

The steel sheets manufactured as described above were evaluated for properties as described below. Results are shown in Table 3.

Tensile Properties

A JIS No. 5 tensile specimen was taken from each manufactured steel sheet such that a rolling transverse direction coincided with a longitudinal direction (tensile direction). The JIS No. 5 tensile specimen was measured for yield stress (YS), tensile strength (TS), and elongation (EL) by tensile testing (JIS Z 2241 (1998)) and the yield ratio (YR) thereof was determined.

Stretch Flangeability

After a hole with a diameter of 10 mm was punched in a specimen taken from each manufactured steel sheet in accordance with The Japan Iron and Steel Federation standards (JFS T 1001 (1996)) with a clearance of 12.5% and was set on a tester such that burrs were on the die side, the hole expansion ratio (λ) was measured by forming using a 60-degree conical punch. A specimen with a λ of 40% or more was judged to be a steel sheet with good stretch flangeability.

Microstructure of Steel Sheet

The volume fraction of ferrite and martensite in each steel sheet was determined using the software Image-Pro developed by Media Cybernetics such that a through-thickness cross section of the steel sheet that was parallel to the rolling direction of the steel sheet was polished, corroded with 3% nital, and observed at 2,000× or 5,000× magnification using a SEM (scanning electron microscope). In particular, the area fraction was measured by a point-counting method (in accordance with ASTM E562-83 (1998)). The area fraction was used to determine the volume fraction. Since the area of ferrite can be calculated such that photographs of ferrite grains identified in advance are taken from a photograph of the microstructure of the steel sheet using the software Image-Pro, the average grain size of ferrite was determined such that the equivalent circle diameters of the ferrite grains were calculated and were averaged. The volume fraction of retained austenite was determined such that the steel sheet was polished to a through-thickness ¼ surface and the X-ray diffraction intensity of the through-thickness ¼ surface was determined. The integrated intensity of the X-ray diffraction line from each of the {200} plane, {211} plane, and {220} plane of iron ferrite and the {200} plane, {220} plane, and {311} plane of austenite was measured at an accelerating voltage of 50 keV by X-ray diffractometry (equipment: RINT 2200 manufactured by Rigaku Corporation) using the Kα line of Mo as a line source. These measurements were used to determine the volume fraction of retained austenite from a calculation formula specified in Rigaku Corporation, "X-ray Diffraction Handbook," 2000, pp. 26 and 62-64.

The number of retained austenite with a grain size of 2 μm or less, martensite with a grain size of 2 μm or less, or a mixture thereof was determined such that the steel sheet was observed at 5,000× magnification using a SEM (scanning electron microscope) and white contrast portions and phases with a size of 2 μm or less were counted in a 2,000 $\mu m^2$ area.

The microstructure of the steel sheet was observed using a SEM (scanning electron microscope), a TEM (transmission electron microscope), and an FE-SEM (field emission scanning electron microscope, whereby the type of a steel microstructure other than ferrite, retained austenite, and martensite was determined.

The results shown in Table 3 show that our Examples have a ferrite volume fraction of 3% to 20%, an average ferrite grain size of 5 μm or less, and a multi-phase microstructure containing 5% to 20% retained austenite and 5% to 20% martensite on a volume fraction basis, the remainder being bainite and/or tempered martensite, and our Examples, the number of retained austenite with a grain size of 2 μm or less, martensite with a grain size of 2 μm or less, or a mixture thereof as observed in a through-thickness cross section parallel to a rolling direction is 150 or more per 2,000 $\mu m^2$. In our Examples, a tensile strength of 1,180 MPa or more and a yield ratio of 75% or more are ensured and an elongation of 17.5% or more and a hole expansion ratio of 40% or more are achieved. However, in the Comparative Examples, steel components and the microstructure of steel sheets are outside our range and, as a result, at least one of tensile strength, yield ratio, elongation, and stretch flangeability is inferior.

TABLE 1

| | Chemical composition (mass percent) | | | | | | | | |
|---|---|---|---|---|---|---|---|---|---|
| Steel | C | Si | Mn | P | S | Al | N | Others | Remarks |
| A | 0.21 | 1.51 | 2.85 | 0.01 | 0.002 | 0.03 | 0.002 | — | Adequate steel |
| B | 0.19 | 1.66 | 3.03 | 0.01 | 0.001 | 0.03 | 0.003 | — | Adequate steel |
| C | 0.19 | 1.99 | 2.72 | 0.01 | 0.001 | 0.03 | 0.003 | Ti: 0.02 | Adequate steel |
| D | 0.25 | 1.43 | 2.81 | 0.01 | 0.001 | 0.03 | 0.002 | V: 0.02 | Adequate steel |
| E | 0.22 | 1.77 | 2.78 | 0.01 | 0.002 | 0.03 | 0.002 | Nb: 0.02 | Adequate steel |

TABLE 1-continued

| Steel | Chemical composition (mass percent) C | Si | Mn | P | S | Al | N | Others | Remarks |
|---|---|---|---|---|---|---|---|---|---|
| F | 0.18 | 1.51 | 2.91 | 0.01 | 0.001 | 0.03 | 0.002 | B: 0.002 | Adequate steel |
| G | 0.20 | 1.42 | 2.79 | 0.01 | 0.001 | 0.03 | 0.002 | Cr: 0.20 | Adequate steel |
| H | 0.24 | 0.98 | 3.01 | 0.01 | 0.001 | 0.03 | 0.002 | Mo: 0.20 | Adequate steel |
| I | 0.22 | 2.25 | 2.66 | 0.01 | 0.001 | 0.03 | 0.003 | Cu: 0.10 | Adequate steel |
| J | 0.19 | 1.16 | 3.22 | 0.01 | 0.002 | 0.03 | 0.002 | Ni: 0.10 | Adequate steel |
| K | 0.22 | 1.45 | 2.81 | 0.02 | 0.002 | 0.03 | 0.002 | Ca: 0.0035 | Adequate steel |
| L | 0.23 | 1.41 | 2.99 | 0.01 | 0.002 | 0.03 | 0.002 | REM: 0.0028 | Adequate steel |
| M | 0.11 | 1.50 | 3.01 | 0.01 | 0.002 | 0.03 | 0.002 | — | Comparative steel |
| N | 0.20 | 0.48 | 2.66 | 0.01 | 0.002 | 0.02 | 0.003 | — | Comparative steel |
| O | 0.23 | 2.12 | 1.89 | 0.01 | 0.002 | 0.03 | 0.003 | — | Comparative steel |
| P | 0.22 | 0.88 | 3.82 | 0.02 | 0.002 | 0.04 | 0.002 | — | Comparative steel |

Underlined values are outside our scope.

TABLE 2

| Sample | Steel | First annealing conditions: First soaking temperature (° C.) | First soaking time (s) | Cooling Rate 1 (° C./s) | First holding temperature (° C.) | First holding time (s) | Second annealing conditions: Average heating rate (° C./s) | Second soaking temperature (° C.) | Second soaking time (s) | Cooling Rate 2 (° C./s) | Cooling stop temperature (° C.) | Second holding temperature (° C.) | Second holding time (s) |
|---|---|---|---|---|---|---|---|---|---|---|---|---|---|
| 1 | A | 850 | 300 | 10 | 400 | 600 | 10 | 810 | 500 | 10 | 200 | 400 | 600 |
| 2 | A | 850 | 600 | 15 | 380 | 600 | 10 | 790 | 600 | 10 | 150 | 420 | 600 |
| 3 | B | 880 | 180 | 5 | 450 | 300 | 10 | 830 | 600 | 10 | 250 | 380 | 300 |
| 4 | B | 860 | 200 | 10 | 400 | 500 | 5 | 790 | 200 | 15 | 150 | 400 | 500 |
| 5 | B | 880 | 600 | 10 | 420 | 200 | 5 | 840 | 300 | 12 | 220 | 350 | 600 |
| 6 | C | 850 | 500 | 10 | 400 | 250 | 20 | 820 | 300 | 5 | 200 | 400 | 500 |
| 7 | C | 880 | 600 | 20 | 350 | 600 | 10 | 820 | 300 | 10 | 200 | 400 | 500 |
| 8 | D | 860 | 200 | 10 | 480 | 600 | 10 | 820 | 300 | 10 | 180 | 400 | 500 |
| 9 | E | 850 | 300 | 10 | 400 | 300 | 10 | 810 | 300 | 10 | 200 | 450 | 300 |
| 10 | F | 850 | 200 | 5 | 450 | 300 | 10 | 820 | 300 | 20 | 200 | 400 | 300 |
| 11 | G | 850 | 300 | 10 | 400 | 300 | 10 | 810 | 300 | 10 | 220 | 400 | 300 |
| 12 | H | 900 | 300 | 10 | 400 | 300 | 15 | 790 | 300 | 10 | 200 | 400 | 300 |
| 13 | I | 860 | 300 | 20 | 400 | 300 | 10 | 810 | 200 | 5 | 180 | 420 | 300 |
| 14 | J | 850 | 300 | 10 | 400 | 300 | 10 | 820 | 300 | 10 | 200 | 400 | 600 |
| 15 | K | 850 | 100 | 10 | 350 | 300 | 10 | 850 | 180 | 10 | 150 | 400 | 600 |
| 16 | L | 850 | 300 | 10 | 400 | 600 | 5 | 810 | 300 | 10 | 200 | 400 | 600 |
| 17 | B | 750 | 300 | 10 | 400 | 300 | 10 | 820 | 300 | 10 | 200 | 380 | 600 |
| 18 | B | 850 | 3 | 10 | 400 | 600 | 10 | 810 | 300 | 5 | 180 | 400 | 600 |
| 19 | B | 850 | 300 | 1 | 400 | 300 | 10 | 810 | 600 | 10 | 200 | 400 | 600 |
| 20 | B | 850 | 300 | 10 | 200 | 300 | 10 | 820 | 300 | 10 | 200 | 380 | 600 |
| 21 | B | 850 | 300 | 10 | 550 | 300 | 10 | 810 | 300 | 10 | 250 | 400 | 600 |
| 22 | B | 850 | 300 | 10 | 400 | 10 | 10 | 810 | 300 | 10 | 200 | 400 | 600 |
| 23 | B | 850 | 300 | 10 | 400 | 300 | 1 | 810 | 300 | 10 | 200 | 400 | 600 |
| 24 | B | 850 | 300 | 10 | 400 | 300 | 10 | 720 | 300 | 10 | 200 | 400 | 600 |
| 25 | B | 850 | 300 | 10 | 400 | 300 | 10 | 810 | 300 | 1 | 200 | 400 | 600 |
| 26 | B | 850 | 300 | 10 | 400 | 600 | 10 | 820 | 300 | 10 | 80 | 400 | 600 |
| 27 | B | 860 | 300 | 10 | 400 | 300 | 10 | 820 | 500 | 10 | 450 | 480 | 600 |
| 28 | B | 850 | 300 | 10 | 400 | 300 | 10 | 810 | 300 | 10 | 200 | 220 | 600 |
| 29 | B | 850 | 300 | 10 | 400 | 300 | 10 | 820 | 300 | 10 | 200 | 600 | 600 |
| 30 | B | 860 | 300 | 10 | 400 | 600 | 10 | 810 | 300 | 10 | 180 | 400 | 10 |
| 31 | M | 850 | 300 | 10 | 400 | 300 | 10 | 830 | 300 | 10 | 200 | 400 | 600 |
| 32 | N | 880 | 300 | 10 | 400 | 600 | 10 | 810 | 300 | 10 | 180 | 400 | 600 |
| 33 | O | 850 | 300 | 10 | 400 | 300 | 10 | 830 | 300 | 10 | 200 | 400 | 600 |
| 34 | P | 850 | 300 | 10 | 400 | 300 | 10 | 810 | 300 | 10 | 200 | 400 | 600 |

Underlined values are outside our scope.

TABLE 3

| | Steel sheet microstructure* | | | | | | | | | | | |
|---|---|---|---|---|---|---|---|---|---|---|---|---|
| | Ferrite | | Retained | | | Total number of M with grain size of 2 μm or less, RA with grain | | | | | Hole | |
| | Volume | Average grain | austenite Volume | Martensite Volume | Rest | size of 2 μm or less, or | Tensile properties | | | | expansion ratio | |
| Sample | fraction (%) | size (μm) | fraction (%) | fraction (%) | microstructure Type | mixture thereof | YS (MPa) | TS (MPa) | EL (%) | YR (%) | λ (%) | Remarks |
| 1 | 7 | 3 | 12 | 11 | B, TM | 211 | 1011 | 1182 | 19.5 | 86 | 50 | Example |
| 2 | 6 | 2 | 13 | 14 | B, TM | 199 | 1002 | 1188 | 18.4 | 84 | 47 | Example |
| 3 | 10 | 3 | 10 | 8 | B, TM | 188 | 988 | 1181 | 17.9 | 84 | 44 | Example |
| 4 | 5 | 2 | 14 | 16 | B, TM | 225 | 923 | 1205 | 17.8 | 77 | 43 | Example |
| 5 | 6 | 3 | 11 | 12 | B, TM | 190 | 1011 | 1188 | 18.1 | 85 | 48 | Example |
| 6 | 5 | 2 | 10 | 14 | B, TM | 183 | 989 | 1193 | 18.0 | 83 | 41 | Example |
| 7 | 6 | 2 | 13 | 13 | B, TM | 185 | 905 | 1189 | 17.7 | 76 | 43 | Example |
| 8 | 5 | 2 | 14 | 18 | B, TM | 209 | 932 | 1222 | 17.6 | 76 | 40 | Example |
| 9 | 6 | 2 | 12 | 15 | B, TM | 194 | 923 | 1196 | 17.8 | 77 | 45 | Example |
| 10 | 6 | 3 | 13 | 12 | B, TM | 201 | 1022 | 1198 | 18.8 | 85 | 53 | Example |
| 11 | 8 | 3 | 8 | 15 | B, TM | 184 | 956 | 1189 | 17.8 | 80 | 43 | Example |
| 12 | 7 | 2 | 10 | 13 | B, TM | 188 | 977 | 1222 | 17.6 | 80 | 41 | Example |
| 13 | 7 | 2 | 11 | 10 | B, TM | 181 | 905 | 1189 | 17.8 | 76 | 40 | Example |
| 14 | 6 | 4 | 13 | 15 | B, TM | 203 | 944 | 1199 | 17.9 | 79 | 43 | Example |
| 15 | 4 | 2 | 14 | 16 | B, TM | 189 | 974 | 1223 | 18.5 | 80 | 44 | Example |
| 16 | 7 | 3 | 12 | 11 | B, TM | 201 | 1005 | 1222 | 18.4 | 82 | 46 | Example |
| 17 | 6 | 3 | 11 | 13 | B, TM | 58 | 859 | 1189 | 17.4 | 72 | 15 | Comparative Example |
| 18 | 7 | 4 | 9 | 16 | B, TM | 78 | 889 | 1181 | 17.5 | 75 | 19 | Comparative Example |
| 19 | 8 | 3 | 11 | 14 | B, TM | 58 | 899 | 1185 | 17.8 | 76 | 22 | Comparative Example |
| 20 | 10 | 4 | 12 | 10 | B, TM | 45 | 933 | 1189 | 17.1 | 78 | 21 | Comparative Example |
| 21 | 10 | 3 | 9 | 8 | B, TM | 49 | 944 | 1190 | 17.8 | 79 | 19 | Comparative Example |
| 22 | 8 | 3 | 11 | 9 | B, TM | 34 | 931 | 1205 | 17.5 | 77 | 16 | Comparative Example |
| 23 | 12 | 7 | 10 | 15 | B, TM | 91 | 911 | 1181 | 18.1 | 77 | 19 | Comparative Example |
| 24 | 18 | 5 | 6 | 4 | B, TM | 21 | 900 | 1188 | 18.3 | 76 | 15 | Comparative Example |
| 25 | 10 | 2 | 8 | 6 | B, TM, P | 29 | 933 | 1195 | 15.4 | 78 | 29 | Comparative Example |
| 26 | 8 | 2 | 4 | 12 | B, TM | 105 | 984 | 1199 | 15.9 | 82 | 49 | Comparative Example |
| 27 | 9 | 3 | 17 | 16 | B | 41 | 610 | 1211 | 19.8 | 50 | 13 | Comparative Example |
| 28 | 7 | 3 | 6 | 28 | B, TM | 188 | 788 | 1202 | 17.1 | 66 | 32 | Comparative Example |
| 29 | 8 | 4 | 4 | 8 | B, TM, P | 112 | 888 | 1181 | 13.8 | 75 | 31 | Comparative Example |
| 30 | 7 | 4 | 8 | 25 | B, TM | 225 | 655 | 1230 | 17.0 | 53 | 11 | Comparative Example |
| 31 | 22 | 3 | 7 | 8 | B, TM | 132 | 720 | 1151 | 18.8 | 63 | 31 | Comparative Example |
| 32 | 10 | 4 | 11 | 26 | B, TM | 199 | 812 | 1198 | 17.2 | 68 | 12 | Comparative Example |
| 33 | 24 | 7 | 12 | 8 | B, TM | 153 | 911 | 1181 | 17.8 | 77 | 38 | Comparative Example |
| 34 | 5 | 2 | 13 | 22 | B, TM | 201 | 874 | 1221 | 17.6 | 72 | 11 | Comparative Example |

Underlined values are outside our scope.

* Steel sheet microstructure: B represents bainite, TM represents tempered martensite, P represents pearlite, M represents martensite, and RA represents retained austenite.

The invention claimed is:

1. A high-strength cold-rolled steel sheet having a composition and a microstructure, the composition comprising:

0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities, and the microstructure comprising:

ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite; and the total number of retained austenite with a grain size of 2 μm or less, martensite with a grain size of 2 μm or less and a mixed phase thereof with a grain size of 2 μm or less being 150 or more per 2,000 $\mu m^2$ of a thickness cross section parallel to the rolling direction of the steel sheet.

2. The high-strength cold-rolled steel sheet according to claim 1, wherein the composition further contains at least one selected from the group consisting of 0.10% or less V, 0.10% or less Nb, and 0.10% or less Ti on a mass basis.

3. The high-strength cold-rolled steel sheet according to claim 1, wherein the composition further contains 0.0050% or less B on a mass basis.

4. The high-strength cold-rolled steel sheet according to claim 1, wherein the composition further contains at least one selected from the group consisting of 0.50% or less Cr, 0.50% or less Mo, 0.50% or less Cu, and 0.50% or less Ni on a mass basis.

5. The high-strength cold-rolled steel sheet according to claim 1, wherein the composition further contains at least one selected from the group consisting of 0.0050% or less Ca and 0.0050% or less of a REM on a mass basis.

6. A method of manufacturing the high-strength cold-rolled steel sheet according to claim 1 comprising:

preparing a steel slab having the composition according to claim 1;

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

7. A method of manufacturing the high-strength cold-rolled steel sheet according to claim 2 comprising:

preparing a steel slab having the composition according to claim 2;

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

8. A method of manufacturing the high-strength cold-rolled steel sheet according to claim 3 comprising:

preparing a steel slab having the composition according to claim 3;

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

9. A method of manufacturing the high-strength cold-rolled steel sheet according to claim 4 comprising:

preparing a steel slab having the composition according to claim 4;

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

10. A method of manufacturing the high-strength cold-rolled steel sheet according to claim 5 comprising:

preparing a steel slab having the composition according to claim 5;

hot-rolling the steel slab to produce hot-rolled steel sheet;

pickling the hot-rolled steel sheet;

cold-rolling the hot-rolled steel sheet to produce a cold-rolled steel sheet;

subjecting the cold-rolled steel sheet to a first annealing, the first annealing comprising:

holding the cold-rolled steel sheet at a first soaking temperature of 800° C. or higher for 30 seconds or more, cooling the cold-rolled steel sheet from the first soaking temperature to 320° C. to 500° C. at a first average cooling rate of 3° C./s or more, holding the cold-rolled steel sheet in a first holding temperature range of 320° C. to 500° C. for 30 seconds or more, and cooling the cold-rolled steel sheet to room temperature;

subjecting the cold-rolled steel sheet to a second annealing, the second annealing comprising:

heating the cold-rolled steel sheet to a second soaking temperature of 750° C. or higher at an average heating rate of 3° C./s to 30° C./s, holding the cold-rolled steel sheet for 30 seconds or more, cooling the cold-rolled steel sheet from the second soaking temperature to 120° C. to 320° C. at a second average cooling rate of 3° C./s or more, heating the cold-rolled steel sheet to a second holding temperature range of 320° C. to 500° C., is held for 30 seconds or more, and cooling the cold-rolled steel sheet to room temperature.

11. The high-strength cold-rolled steel sheet according to claim 2, wherein the composition further contains 0.0050% or less B on a mass basis.

12. The high-strength cold-rolled steel sheet according to claim 2, wherein the composition further contains at least one selected from the group consisting of 0.50% or less Cr, 0.50% or less Mo, 0.50% or less Cu, and 0.50% or less Ni on a mass basis.

13. The high-strength cold-rolled steel sheet according to claim 3, wherein the composition further contains at least one selected from the group consisting of 0.50% or less Cr, 0.50% or less Mo, 0.50% or less Cu, and 0.50% or less Ni on a mass basis.

14. The high-strength cold-rolled steel sheet according to claim 11, wherein the composition further contains at least one selected from the group consisting of 0.50% or less Cr, 0.50% or less Mo, 0.50% or less Cu, and 0.50% or less Ni on a mass basis.

15. The high-strength cold-rolled steel sheet according to claim 2, wherein the composition further contains at least one selected from the group consisting of 0.0050% or less Ca and 0.0050% or less of a REM on a mass basis.

16. The high-strength cold-rolled steel sheet according to claim 3, wherein the composition further contains at least one selected from the group consisting of 0.0050% or less Ca and 0.0050% or less of a REM on a mass basis.

17. The high-strength cold-rolled steel sheet according to claim 4, wherein the composition further contains at least one selected from the group consisting of 0.0050% or less Ca and 0.0050% or less of a REM on a mass basis.

18. The high-strength cold-rolled steel sheet according to claim 11, wherein the composition further contains at least one selected from the group consisting of 0.0050% or less Ca and 0.0050% or less of a REM on a mass basis.

19. The high-strength cold-rolled steel sheet according to claim 12, wherein the composition further contains at least one selected from the group consisting of 0.0050% or less Ca and 0.0050% or less of a REM on a mass basis.

20. The high-strength cold-rolled steel sheet according to claim 13, wherein the composition further contains at least one selected from the group consisting of 0.0050% or less Ca and 0.0050% or less of a REM on a mass basis.

21. The high-strength cold-rolled steel sheet according to claim 14, wherein the composition further contains at least one selected from the group consisting of 0.0050% or less Ca and 0.0050% or less of a REM on a mass basis.

* * * * *